US006321833B1

(12) United States Patent
O'Leary et al.

(10) Patent No.: US 6,321,833 B1
(45) Date of Patent: Nov. 27, 2001

(54) SINUSOIDAL FIN HEAT EXCHANGER

(75) Inventors: Timothy O'Leary, Antioch; David L. Schardt, Brentwood; Brady A. Mills; Vance Willis, both of Nashville, all of TN (US)

(73) Assignee: H-Tech, Inc., Wilmington, DE (US)

( * ) Notice: Subject to any disclaimer, the term of this patent is extended or adjusted under 35 U.S.C. 154(b) by 0 days.

(21) Appl. No.: 09/419,377

(22) Filed: Oct. 15, 1999

(51) Int. Cl.[7] ..... F28D 1/053
(52) U.S. Cl. ..... 165/151; 165/182
(58) Field of Search ..... 165/151, 181, 165/182

(56) References Cited

U.S. PATENT DOCUMENTS

| | | | | |
|---|---|---|---|---|
| 1,618,485 | | 2/1927 | Skinner | 165/151 |
| 1,775,041 | | 9/1930 | Karmazin | 165/151 |
| 1,927,325 | | 9/1933 | Ritter . | |
| 1,940,804 | | 12/1933 | Karmazin . | |
| 2,055,499 | | 9/1936 | King | 165/151 |
| 2,132,372 | | 10/1938 | Locke . | |
| 2,184,345 | | 12/1939 | Hersey . | |
| 2,381,215 | | 8/1945 | Hahn . | |
| 2,884,197 | | 4/1959 | Whittell, Jr. . | |
| 2,950,092 | | 8/1960 | DiNiro . | |
| 2,994,123 | | 8/1961 | Kritzer . | |
| 3,080,916 | | 3/1963 | Collins . | |
| 3,182,481 | * | 5/1965 | Oddy et al. | 165/151 |
| 3,250,323 | | 5/1966 | Karmazin . | |
| 3,250,324 | | 5/1966 | Hicks . | |
| 3,840,175 | | 10/1974 | Jacuzzi . | |
| 3,902,551 | | 9/1975 | Lim et al. . | |
| 3,916,989 | | 11/1975 | Harada et al. . | |
| 4,169,502 | | 10/1979 | Kluck | 165/151 |
| 4,361,276 | | 11/1982 | Paige . | |
| 4,434,843 | | 3/1984 | Alford . | |
| 4,449,581 | | 5/1984 | Blystone et al. . | |
| 4,465,128 | | 8/1984 | Krekacs et al. . | |
| 4,580,623 | | 4/1986 | Smitte et al. . | |
| 4,592,420 | | 6/1986 | Hughes . | |
| 4,715,437 | | 12/1987 | Tanaka et al. . | |
| 4,738,225 | | 4/1988 | Juang . | |
| 4,759,405 | | 7/1988 | Metzger . | |
| 4,856,824 | | 8/1989 | Clausen . | |
| 4,923,002 | | 5/1990 | Haussmann . | |
| 5,094,224 | | 3/1992 | Diesch . | |
| 5,190,101 | | 3/1993 | Jalilevand et al. . | |
| 5,222,550 | | 6/1993 | Griffin et al. . | |
| 5,318,112 | * | 6/1994 | Gopin | 165/151 |
| 5,482,115 | | 1/1996 | Ikeya et al. | 165/151 |
| 5,660,230 | | 8/1997 | Obosu et al. | 165/151 |
| 5,711,369 | | 1/1998 | Huddleston et al. . | |

FOREIGN PATENT DOCUMENTS

| | | | | |
|---|---|---|---|---|
| 633229 | * | 1/1928 | (FR) | 165/151 |
| 859865 | * | 12/1940 | (FR) | 165/151 |
| 332455 | | 7/1930 | (GB) . | |
| 60-82785 | * | 5/1985 | (JP) | 165/151 |
| 60-188796 | * | 9/1985 | (JP) | 165/151 |
| 62-175591 | * | 8/1987 | (JP) | 165/151 |
| 63-3180 | * | 1/1988 | (JP) | 165/151 |
| 4-229694 | * | 8/1994 | (JP) | 165/151 |
| 964422 | | 10/1982 | (RU) . | |

* cited by examiner

*Primary Examiner*—Leonard Leo
(74) *Attorney, Agent, or Firm*—Selitto, Behr & Kim

(57) ABSTRACT

A fin and tube heat exchanger includes fins shaped along dynamically, empirically determined isothermal lines. The fins preferably have deflectors along a trailing edge thereof to concentrate heat flux into a back row of tubes. The deflectors bridge adjacent fins to define baffles. The preferred fin shape may be obtained empirically by trimming fin areas exhibiting excessive temperatures during operation.

17 Claims, 6 Drawing Sheets

SINUSOIDAL FIN HEAT EXCHANGER

FIELD OF THE INVENTION

The present invention relates to heat exchangers and more particularly to fin tube heat exchangers for use in hydrocarbon fueled water heaters.

BACKGROUND OF THE INVENTION

Numerous heat exchanger apparatus have been proposed in the past. Common objectives are economy of manufacture, efficiency of heat transfer, safety and long service life. Various prior art patents disclose heat exchanger methods and apparatus for accomplishing the foregoing general objectives. For example, U.S. Pat. No. 3,080,916 to Collins discloses a heat exchanger with a continuous tube threaded back and forth through a plurality of fins. The tube has a plurality of straight sections forming tube rows with spacing between adjacent tube rows. A first row of tubing sections is offset from a second row to permit air to pass through the first row and contact the second row.

U.S. Pat. No. 4,738,225 to Juang discloses a fin and tube heat exchanger having a 4×4 block of spaced tubes threaded through a multitude of fins. Flow through the tubes is split and merged by a plurality of flow splitting and flow merging manifolds that bridge adjacent tubes at either end of the heat exchanger. As in U.S. Pat. No. 3,080,916, the tubes in adjacent rows are staggered. The fin plates have a plurality of fin arrays to promote air turbulence to enhance heat transfer.

U.S. Pat. No. 4,169,502 to Kluck teaches a tube and fin heat exchanger for use as an automobile radiator wherein the tubes are arranged on a sinusoidal, wave or zig zag line. This arrangement, according to the patent, exposes all tubes to the cooling air current. The fins are provided with tear holes which, in conjunction with tube passage collars, space adjacent fins one from another.

U.S. Pat. No. 5,660,230 to Obusu et al. discloses a fin and tube heat exchanger wherein the leading and trailing edges of the fins have a sinusoidal or trapezoidal wave shape, with the leading and trailing edges described as being contoured to conform with isotherms around the fluid flowing through the tubes. The patent suggests that this form of fin promotes economy of manufacture by avoiding material wastage. Each of the fins has a plurality of louvers aligned on the fin body along the isotherms.

Notwithstanding the existing fin and tube heat exchanger technology, it remains an object in the field to produce heat exchangers which are yet more efficient, safe, durable, economical to produce and such is the object of the present invention.

SUMMARY OF THE INVENTION

The problems and disadvantages associated with the conventional techniques and apparatus used for heat exchange are overcome by the present invention which includes a heat exchanger with a plurality of tubes for conducting a first fluid flowing therethrough. A plurality of fins is disposed generally transverse to the tubes with the tubes extending through apertures in the fins and in contact therewith such that heat can be transferred between the fins and the tubes. The fins are in contact with a second fluid, which at selected times flows around the fins from a leading edge to a trailing edge thereof. The leading edge of at least one of the fins is shaped along an isotherm generated during the flowing of the first fluid and the second fluid. A method for empirically determining fin shape includes trimming fin areas exhibiting excessive temperatures during operation.

BRIEF DESCRIPTION OF THE FIGURES

For a better understanding of the present invention, reference is made to the following detailed description of an exemplary embodiment considered in conjunction with the accompanying drawings, in which.

DETAILED DESCRIPTION OF THE FIGURES

Figure 1:
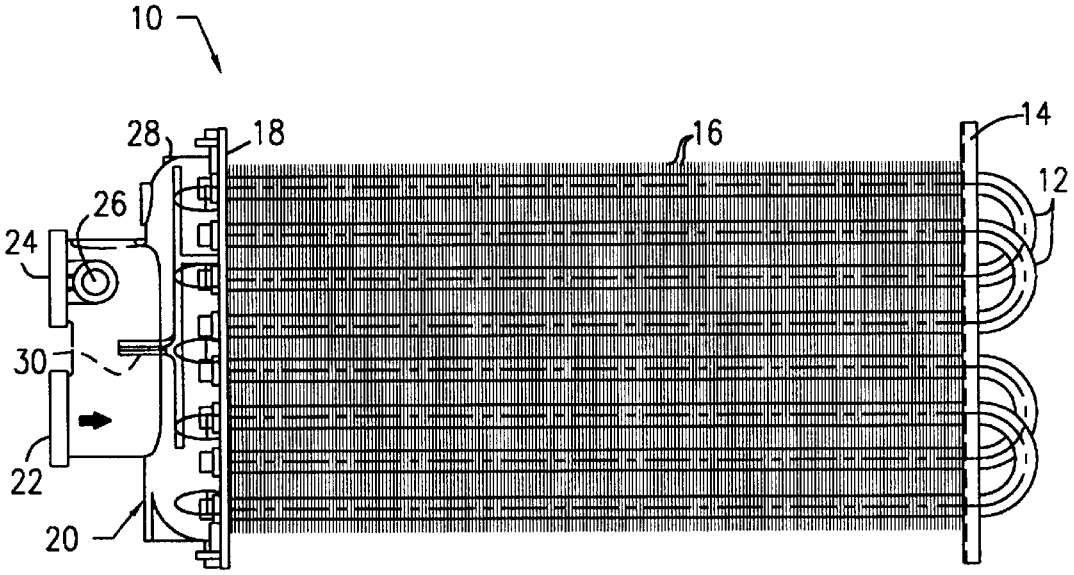
FIG. 1 is a plan view of a heat exchanger in accordance with an exemplary embodiment of the present invention.

FIG. 1 shows a heat exchanger 10 in accordance with the present invention. The heat exchanger 10 has a plurality of U-shaped tubes 12 that are threaded through a rear tubesheet 14, a plurality of fins 16 and a front tubesheet 18. The tubes 12 are held in sealed relationship to the front header 18 by internal expansion, welding, soldering or other conventional means. In the embodiment shown, a stainless steel or other corrosion resistant material is preferred for the front tubesheet 18 in that it is contacted by the fluid to be heated, which, in many instances, e.g. water, is corrosive and otherwise would oxidize the tubesheet 18 thereby weakening the tubesheet 18 as well as contaminating the water. Since the rear tubesheet 14 does not contact the fluid to be heated, its composition need only be compatible with the tube 12 material, i.e., it is preferable to avoid electrolytic action at the tube 12/rear tubesheet 14 junction.

A manifold 20 is attached to the front tubesheet 18 by peripheral fasteners such as bolts or clamps and has an inlet 22 and an outlet 24. The manifold 20 may also have orifices 26, 28 to receive temperature and pressure sensors. The manifold 20 has an internal baffle 30 that divides the internal hollow of the manifold 20 into a plurality of sections for routing the fluid to be heated through the tubes 12. The baffle 30 is typically provided with a bleed aperture connecting the cold side and the warm side of the manifold as well as a pressure sensitive bypass valve to control flow between the warm and cold sides of the manifold 20. As is described in U.S. patent application Ser. No. 08/801,077 filed Feb. 14, 1997 now U.S. Pat. No. 6,026,804, which has been assigned to the Assignee hereof, and which is incorporated herein for its teachings concerning the structure, manufacture and composition of corrosion resistant heat exchangers, the manifold 20 is preferably formed from plastic due to economy of materials and corrosion resistance.

Figure 2:
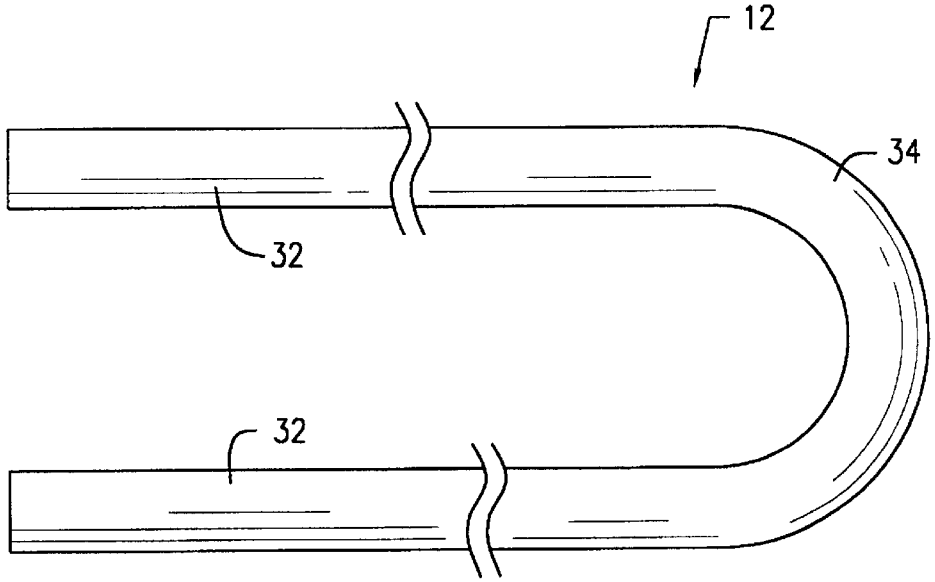
FIG. 2 is a plan view of a U-shaped tube from the heat exchanger of FIG. 1.

FIG. 2 shows a U-shaped tube 12 having a pair of elongated legs 32 extending from a common U-shaped junction area 34. In the case of a water heater, the tube is preferably formed from copper.

Figure 3:
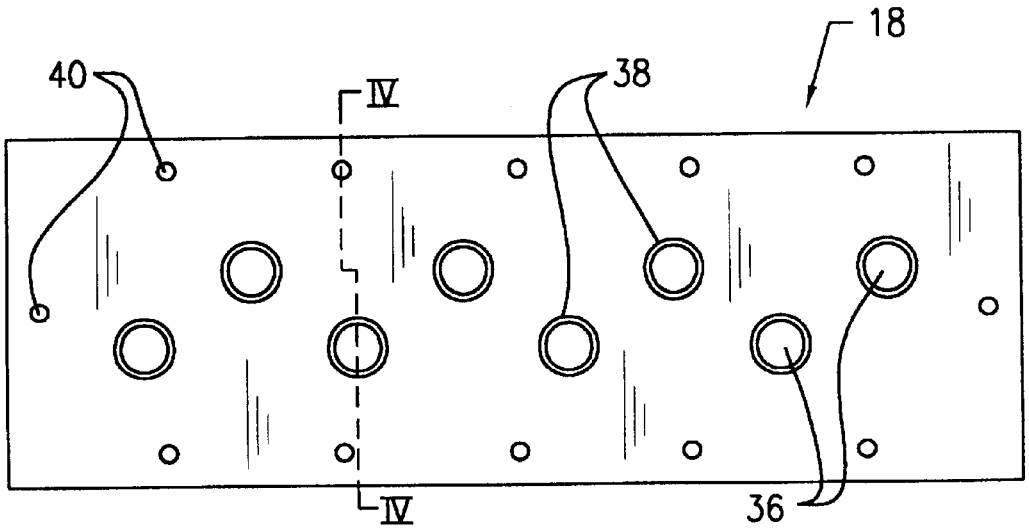
FIG. 3 is a side view of a tube sheet of the heat exchanger of FIG. 1.
Figure 4:
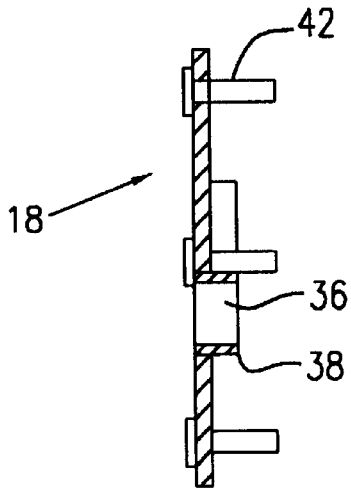
FIG. 4 is a cross-sectional view of the tubesheet of FIG. 3, taken along section lines IV—IV and looking in the direction of the arrows.

FIGS. 3 and 4 show the front tubesheet 18 having a plurality of tube apertures 36 into which the tubes 12 may be inserted and sealed. When using thin tubesheet material, the apertures 36 are preferably provided with flanges 38 to increase the contact area between the tubes 12 and the tubesheet apertures 36. The tubesheet 18 may include a plurality of apertures 40 for receiving threaded fasteners, such as studs or bolts 42 that are used to hold the manifold 20 to the tubesheet 18.

Figure 5:
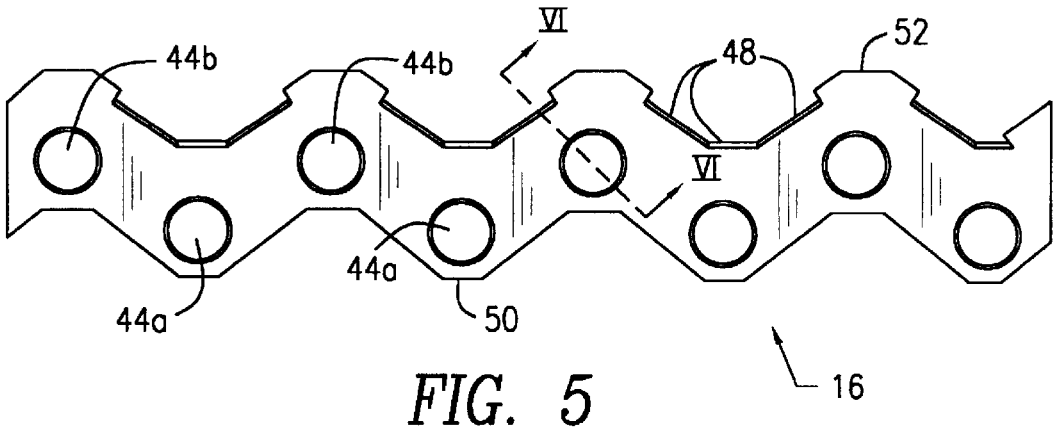
FIG. 5 is a side view of a fin of the heat exchanger of FIG. 1.
Figure 6:
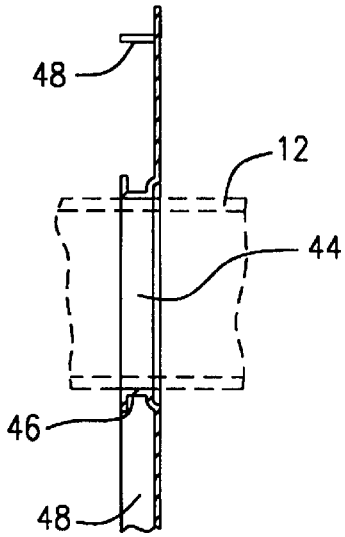
FIG. 6 is a cross-sectional view of the fin of FIG. 5, taken along section line VI—VI and looking in the direction of the arrows.

FIGS. 5 and 6 show the fin 16 used in the present invention and that has a plurality of tube apertures 44*a* (front row) and 44*b* (back row) and cumulatively referred to herein as 44. To increase thermal conductivity between the tubes 12 and the fin 16, flanges 46 may be employed. The flanges 46 also serve as spacers for spacing adjacent fins 16. A plurality of flow deflectors 48 extends from the surface of the fin 16 for directing air/combustion product flow through the heat exchanger 10. The flow deflectors 48 also prevent radiation heat flux from passing through the heat exchanger unimpeded. The deflectors 48 either reflect the radiation back to the combustion chamber or absorb it. More particularly, the deflectors 48 of a first fin 16 extend to contact the surface of an adjacent fin 16, thereby forming a baffle for directing flow of combustion products, hot air, radiation, etc., which for present purposes can be cumulatively referred to as the "heating flux". The flow deflectors 48 thus preferably extend approximately the same distance from the surface of the fin 16 as the flanges 46 and therefore complement the fin spacing function as well as performing the flow directing function.

As can be seen in FIG. 5, the flow deflectors 48 are arranged to converge the flow of heating flux toward the back row of tubes 12 (placed in apertures 44*b*). As the heating flux passes over a leading edge 50 of the fin 16, heat is lost to the fin 16 and, upon contacting a tube 12, to the tube. The loss of heat causes a contraction of the heating flux, a diminishment of the radiation present in the flux and a lessening of the velocity of the molecules present in the flux. Each of these effects diminishes the heating flux per unit volume as it passes from the leading edge 50 of the fin to a trailing edge 52. The convergence and directing of the heating flux toward the tubes 12 in the back row of the heat exchanger 10 by the deflectors 48 compensates for the loss of flux density by increasing the velocity and concentration of the flux and directing it into contact with the back row tubes 12 where it can then transfer more heat to the back row tubes 12.

The fin 16 has a generally sinusoidal shape attributable to the tube 12 stacking/spacing configuration and the shaping of the fins to coincide with isotherms on the fin 16, as encountered during heat exchanger use, i.e., when the heat exchanger is exposed to and heated by the normal flow of combustion products external to the tubes 12 and exposed to and cooled by the fluid to be heated internal to the tubes 12 (both taken at maximum operating temperatures plus a safety factor of 20%). In shaping the fins 16, there are two competing objectives, viz., to use as little material as possible while, at the same time, maximizing heat transfer. Since the heat exchanger 10 is subject to the high heats associated with combustion, the fin shape must be designed within the limitations of the materials used, e.g., its melting point. Accordingly, the present invention involves selecting the correct isotherm for the application, given the material used for the fin, its dimensions, heat transfer capabilities, the operating temperatures of the heat exchanger, heat transfer capacity at the tube/fin junction, etc.

Due to the complex physical processes present, development of a formula by which an isotherm can be selected is impractical. The fin 16 absorbs heat from the combustion product gases by both radiation and convection. The local heat flux due to convection varies from point to point along the fin surface depending on local flow conditions. In general, the local convection heat flux will tend to decrease as you move from the leading edge 50 of the fin 16 toward the trailing edge 52. The local heat flux due to radiation at a given point on the fin surface depends on the intensity of the radiation that reaches that point. The amount of radiation that strikes the fin surface also varies from point to point. More radiation will reach points on the fin 16 closer to the leading edge 50 since the trailing edge 52 of the fin 16 will be shielded by the first and second rows of tubes and by the fin surface closer to the leading edge. Calculating the isotherms would require quantifying the local convection and radiation heat fluxes on the fin at all points. While It may be possible to employ a computational numerical method to accomplish this, it is more straightforward to use an experimental method.

Isotherms may be selected empirically by attaching an array of thermocouples to the fin 16. These thermocoupled fins are then used in the fabrication of a prototype heat exchanger which is then installed in a heater. The heater is operated and the temperatures sensed by the thermocouples are recorded. The contour of the fin 16 is adjusted until the thermocouples all read temperatures at or below the maximum allowable fin temperature, i.e., areas exhibiting excessive temperature during operation are trimmed.

One may note that the greater the heat capacity of the tube/fin junction, i.e., the rate and volume of heat flux that can be transferred through the junction and the rate of heat conduction through the fin material, the further the leading edge 50 may extend from the front row tubes (in apertures 44*a*) without melting. The greater the temperature and velocity of the combustion products encountering the leading edge 50 of the fin 16, i.e., the initial heat flux, the shorter the leading edge 50 may extend from the tube 12 without melting. The lower the temperature of the tube contents, i.e., the water to be heated, the longer the leading edge 50 can extend from the tube 12 without melting.

As to the shape selected for the trailing edge 52, it can be appreciated that it is different from the leading edge 50 for the following reasons. The trailing edge 52 is located 1½ to 2 times further from the rear row of tubes (in apertures 44*b*) than the leading edge 50 is from the front row of tubes (in apertures 44*a*). The trailing edge 52 can be located further out than the leading edge 50 because heat fluxes and isotherm magnitudes are lower at the trailing edge 52. The heat fluxes and isotherm magnitudes are lower since the combustion products have given up much of their heat content to the heat exchanger 10 before they reach the trailing edge 52.

In designing the trailing edge 52, it has been observed that there are competing interests and phenomenon. More particularly, it has been observed that the longer the fin 16, the greater the opportunity for the fin 16 to more thoroughly absorb heat from the combustion products, i.e., based upon duration of contact. This is true to the extent that the fin 16 remains cooler than the combustion products. As is described above, the fins 16 and tubes 12 remove heat from the heat flux, the heat being transferred to the fins 16, to the tubes 12 and to the fluid to be heated. If the trailing edge 52 of the fin 16 is too long and the heat transfer at the leading edge 50 and to the tubes 12 is efficient to the extent that the ambient temperature of the combustion products is less than the temperature of the fin 16 at the trailing edge 52, then the combustion products will cool the fin and the fin 16 will reheat the combustion products at the trailing edge 52, an undesirable consequence.

Another factor in selecting trailing edge shape and dimension is materials cost. Even if the trailing edge 52 of a fin 16 is still extracting more heat from the combustion products than it is giving up, there is the question as to whether the material usage to make the fin 16 is cost effective, i.e., does the cost of the materials of the fin 16 compare favorably to the savings in energy that are realized by the incremental additional efficiency over the life expectancy of the heat exchanger 10?

As in designing the leading edge 50, the trailing edge 52 is shaped by selecting the best isotherm. The trailing edge 52 conforms to an isotherm located at a distance from the rear row of tubes (in apertures 44*b*) that is cost effective with respect to material usage. The trailing edge 52 can be located further out at the isotherm of the maximum temperature for which the fin material has satisfactory mechanical and corrosion resistance properties, however, this location may not be cost effective with respect to material usage. To further maximize material usage by eliminating waste, the trailing edge 52 nests within the leading edge 50 such that a single cut line defines both when the fins 16 are cut from stock.

Figure 7:
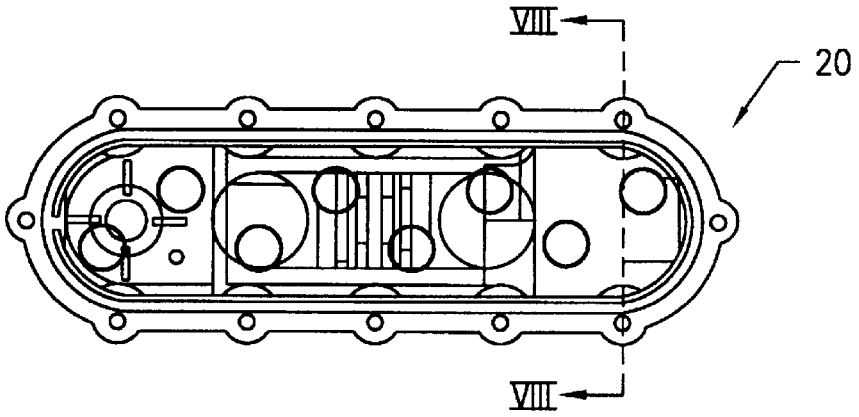
FIG. 7 is a side view of a header of the heat exchanger of FIG. 1.
Figure 8:
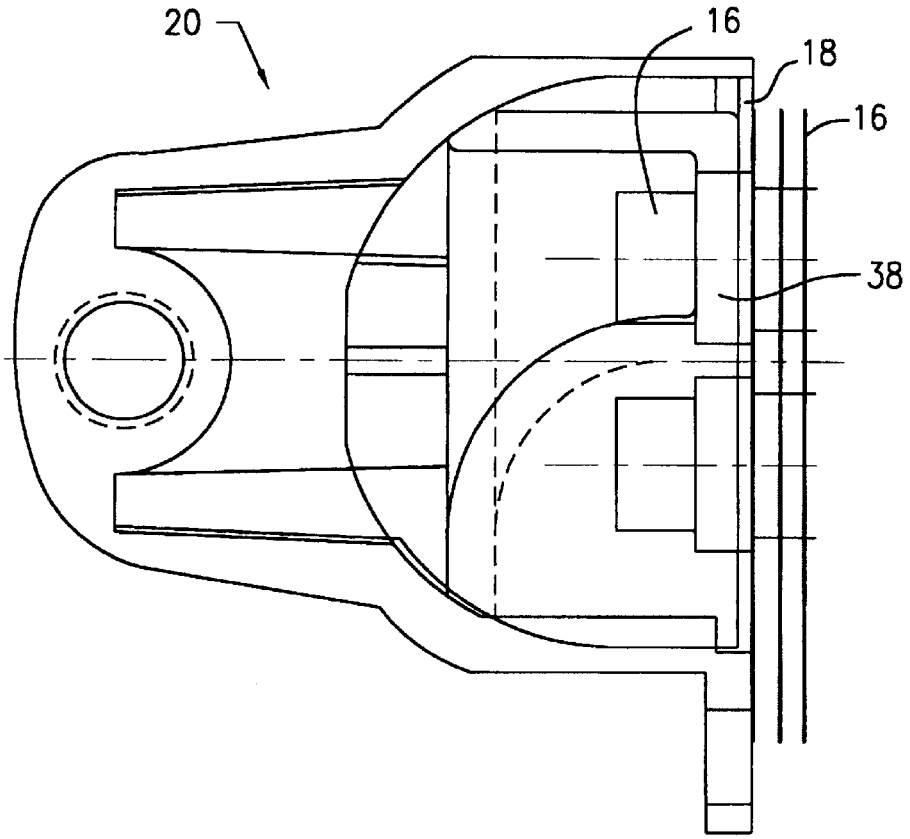
FIG. 8 is a cross-sectional view of the header of FIG. 7 taken along section line VIII—VIII and looking in the direction of the arrows.

FIGS. 7 and 8 depict the front manifold 20 into which the tubes 16 discharge and which routes the flow of water to be heated sequentially through the tubes 16.

Figure 9:
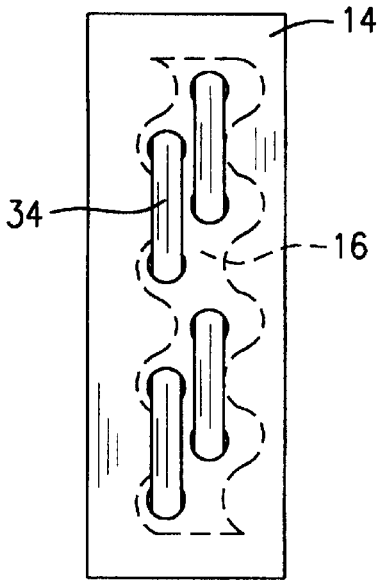
FIG. 9 is a side view of the heat exchanger of FIG. 1, showing the U-shaped tubes of FIG. 2.
Figure 10:
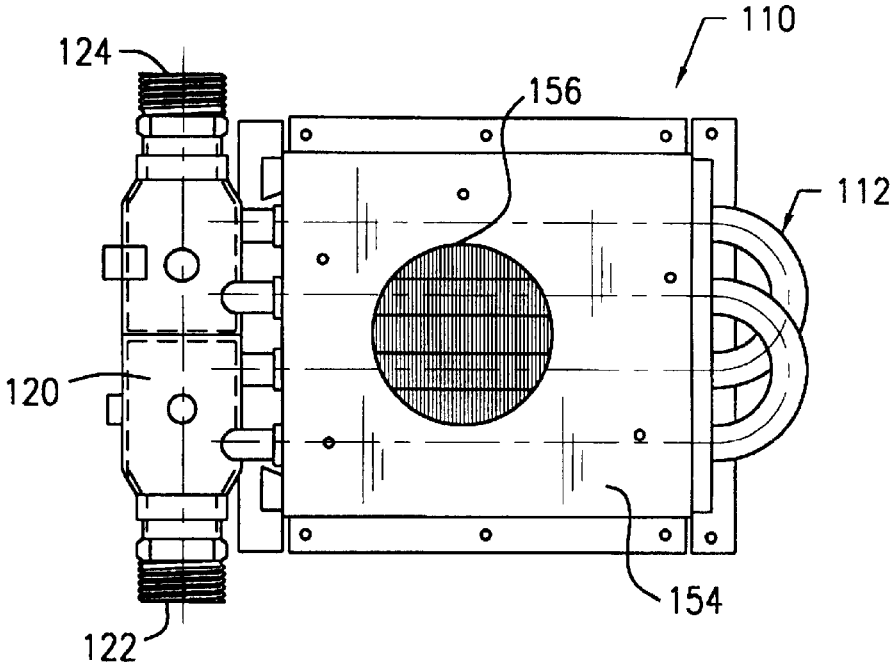
FIG. 10 is a plan view of a heat exchanger in accordance with a second exemplary embodiment of the present invention.
Figure 11:
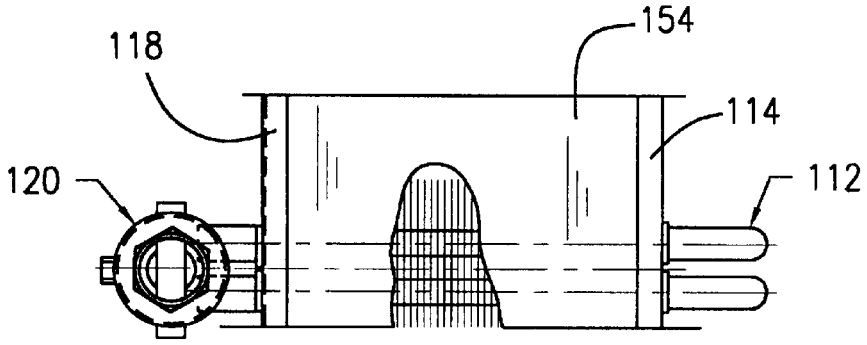
FIG. 11 is a side view of the heat exchanger of FIG. 10.
Figure 12:
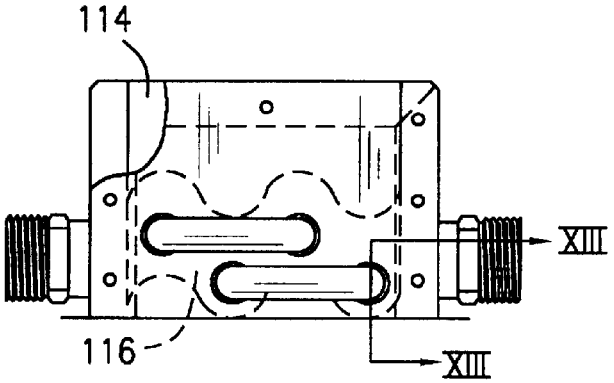
FIG. 12 is a side view of the heat exchanger of FIG. 10.

FIG. 9 shows the rear tube sheet 14 and the U-shaped junction 34 of the tubes 16 protruding therefrom. Because the tubes 16 form a continuous circuit independent of the rear tubesheet 14, there is no need for the tubes 16 to seal against the apertures in the rear tubesheet 14 through which they protrude.

The use of U-shaped tubes 12 eliminates the need for a header or manifold on one end of the heat exchanger 10. This is a substantial cost savings and also enhances the performance of the heat exchanger 10, in that the U-shaped junctions have a clean laminar flow path unlike the flow into and out of a header. By eliminating a header, the rear tube sheet can be selected without concern for corrosion resistance, in that the fluid to be heated never contacts the rear tube sheet. Further, the eliminated header ceases to be a concern as a source of corrosion and the necessity for a water tight junction between the tubesheet and a header is eliminated.

FIGS. 10–13 show an alternate embodiment to that of the heat exchanger 10 shown in FIG. 1. Elements illustrated in FIGS. 10–13 which correspond to elements described above with respect to FIGS. 1–9 have been designated by corresponding reference numerals increased by one hundred. Unless otherwise stated, the embodiment of FIGS. 10–13 functions in the same manner as the embodiment of FIGS. 1–9.

Heat exchanger 110 has a pair of U-shaped tubes 112. A housing 154 shrouds the heat exchanger 110 on the sides and top and channels the flow of combustion products through an outlet opening 156 to which may be attached a conduit leading to an induction blower or to a blower directly. A manifold 120 with opposing inlet 122 and outlet 124 attaches to the tubes 112. A rear tube sheet 114 and a front tube sheet 118 cooperate with the housing 154 to provide the desired shrouding effect.

Figure 13:
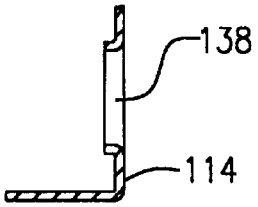
FIG. 13 is a cross-sectional view of a tubesheet of the heat exchanger of FIG. 12, taken along section line XIII—XIII and looking in the direction of the arrows.

FIG. 13 shows that the rear tubesheet 114 may have flanged holes 138 to stiffen the heat exchanger assembly. The same flanged holes may be incorporated into the front tubesheet 118.

It should be understood that the embodiments described herein are merely exemplary and that a person skilled in the art may make many variations and modifications without departing from the spirit and scope of the invention as defined in the appended claims. Accordingly, all such variations and modifications are intended to be included within the scope of the invention as defined in the appended claims.

We claim:

1. A heat exchanger, comprising:

a plurality of tubes for conducting a first fluid flowing therethrough; and a plurality of fins disposed generally transverse to said tubes, said tubes extending through apertures in said fins and in contact therewith such that heat can be transferred between said fins and said tubes, said fins being in contact with a second fluid which flows, at selected times, around each of said fins from a first edge thereof to a second edge thereof, at least said second edge of at least one of said fins is shaped along an isotherm generated during the flowing of the first fluid and the second fluid, said at least one of said fins having deflectors extending from said second edge approximately perpendicularly to the flow of the second fluid and disposed along the isotherm, the second fluid having an associated heat flux and said deflectors concentrating the heat flux relative to at least some of said tubes, thereby increasing heat transfer thereto, said apertures and said tubes being disposed in a plurality of rows distributed along said fins in the direction of flow of the second fluid, upstream to downstream, a downstream row of said tubes receiving the concentrated heat flux.

2. The heat exchanger of claim 1, wherein said first edge of at least one of said fins is shaped along an isotherm, said first edge having a shape which approximates a sinusoidal curve.

3. The heat exchanger of claim 1 wherein said second edge of at least one of said fins has a shape which approximates a sinusoidal curve.

4. The heat exchanger of claim 1, wherein both of said first and second edges of at least one of said fins are shaped along an isotherm generated during the flowing of said first fluid and the second fluid.

5. The heat exchanger of claim 4, wherein said first edge and said second edge of said at least one of said fins are complementary in shape.

6. The heat exchanger of claim 5, wherein said shape approximates a sinusoidal curve.

7. The heat exchanger of claim 6, wherein said deflectors direct the second fluid into increased contact with at least some of said tubes.

8. The heat exchanger of claim 1, wherein said deflectors are tabs extending from at least one of said fins proximate said second edge thereof.

9. A heat exchanger, comprising:

a plurality of tubes for conducting a first fluid flowing therethrough; and a plurality of fins disposed generally transverse to said tubes, said tubes extending through apertures in said fins and in contact therewith such that heat can be transferred between said fins and said tubes, said fins being in contact with a second fluid which flows, at selected times, around each of said fins from a first edge thereof to a second edge thereof, said first edge and said second edge of a least one of said fins being shaped along an isotherm generated during the flowing of the first fluid and the second fluid, each of said first edge and said second edge having a shape which approximates a sinusoidal curve, said second edge of said at least one of said fins being about 1.5 to about 2 times farther from said tubes than said first edge of said at least one of said fins.

10. A heat exchanger, comprising:

a plurality of tubes for conducting a first fluid flowing therethrough; and a plurality of fins disposed generally transverse to said tubes, said tubes extending through apertures in said fins and in contact therewith such that heat can be transferred between said fins and said tubes, said fins being in contact with a second fluid which flows, at selected times, around each of said fins from a first edge thereof to a second edge thereof, at least one of said first and second edges of a least one of said fins being shaped along an isotherm generated during the flowing of the first fluid and the second fluid, at least one of said fins having deflector tabs extending from a surface thereof approximately perpendicularly to the flow of the second fluid and proximate said second edge thereof, said deflectors being juxtaposed on either side of an associated one of said tubes of a downstream row and disposed at approximately right angles relative to each other.

11. The heat exchanger of claim 10, wherein each of said deflectors extends from said at least one of said fins to an adjacent fin against which they abut, thereby forming a baffle therebetween.

12. The heat exchanger of claim 11, wherein at least some of said apertures have flanges extending approximately perpendicularly from their associated fins.

13. The heat exchanger of claim 12, wherein said flanges and said deflectors extend from their associated fins at approximately equal length.

14. The heat exchanger of claim 13, wherein at least some of said tubes are U-shaped with open ends thereof terminating in a manifold.

15. A heat exchanger, comprising:

a plurality of tubes for conducting a first fluid flowing therethrough;

a plurality of fins disposed generally transverse to said plurality of tubes, said tubes extending through apertures in said fins and in contact therewith such that heat can be transferred between said fins and said plurality of tubes, said fins being in contact with a second fluid which flows, at selected times, around said fins from a leading edge to a trailing edge thereof, said apertures and said tubes being disposed in a plurality of rows, one of said plurality of rows being proximate to said leading edge and another of said plurality of rows being proximate to said trailing edge, at least one of said fins having flow deflectors thereon for redirecting the flow of the second fluid into said tubes in said another row of tubes said deflectors being disposed along said trailing edge proximate an isotherm existing during dynamic operation of said heat exchanger with the first and said second fluids flowing.

16. The heat exchanger of claim 15, wherein said flow deflectors extend from trailing edges of said fins, each deflector bridging from its associated fin to an adjacent fin.

17. The heat exchanger of claim 16, wherein said leading edge of said at least one of said fins is determined by isotherms existing during dynamic operation of said heat exchanger with said first and said second fluids flowing, said isotherms being about 20% lower temperature than that which would result in material degradation of said fins.

* * * * *